US005593336A

United States Patent [19]

Thomas

[11] Patent Number: 5,593,336

[45] Date of Patent: Jan. 14, 1997

[54] PACIFIER HOLDER

[76] Inventor: Kristina M. Thomas, 4382 W. Avenida de Golf, Pace, Fla. 32571

[21] Appl. No.: 406,685

[22] Filed: Mar. 20, 1995

Related U.S. Application Data

[63] Continuation-in-part of Ser. No. 24,663, Jun. 20, 1994, Pat. No. Des. 358,653, and a continuation-in-part of Ser. No. 24,653, Jun. 20, 1994, Pat. No. Des. 360,693, and a continuation-in-part of Ser. No. 24,684, Jun. 20, 1994, Pat. No. Des. 360,694.

[51] Int. Cl.[6] ..... A63H 5/00

[52] U.S. Cl. ..... 446/81; 446/419; 446/491; 606/234

[58] Field of Search ..... 446/71, 81, 419, 446/491; 40/915; 150/160; 606/234, 235, 236; D24/194, 195

[56] References Cited

U.S. PATENT DOCUMENTS

| | | | |
|---|---|---|---|
| D. 291,122 | 7/1987 | Grubb | D24/195 |
| D. 337,385 | 7/1993 | Lussier | D24/194 |
| 874,526 | 12/1907 | McLaughlin et al. | 446/419 |
| 1,886,464 | 11/1932 | Bright | 150/160 |
| 2,834,350 | 5/1958 | Beck | 606/236 |
| 3,821,976 | 7/1974 | Smith | 150/160 |
| 4,277,910 | 7/1981 | Kramer | 606/234 |
| 4,699,589 | 10/1987 | King et al. | 606/234 |
| 4,765,037 | 8/1988 | Perry | 606/234 |
| 5,156,617 | 10/1992 | Reid | D24/194 |

FOREIGN PATENT DOCUMENTS

| | | | |
|---|---|---|---|
| 76501 | 1/1950 | Czechoslovakia | 446/419 |
| 985088 | 3/1951 | France | 446/297 |
| 555901 | 11/1958 | Italy | 606/234 |
| 510020 | 7/1939 | United Kingdom | 150/160 |

*Primary Examiner*—Robert A. Hafer
*Assistant Examiner*—Jeffrey Carlson
*Attorney, Agent, or Firm*—George A. Bode; Michael L. Hoelter

[57] ABSTRACT

A pacifier holder for holding a pacifier on its upper surface for easy use by an infant. This pacifier holder consists of a soft lightweight elongated generally tubular member that loosely holds a pacifier on its first or upper end region. The holder is configured such that this first end region is offset by curvature from the remainder of the holder so as to position the pacifier in front of the infant's mouth when in use as the remainder of the elongated holder is placed upon the infant's chest. During use, the holder, being placed on top of the infant, will be positioned such that the pacifier is within easy reach of the infant.

15 Claims, 2 Drawing Sheets

PACIFIER HOLDER

This application is a continuation-in-part application of previous applications by the same inventor bearing U.S. Ser. No. 29/024,663 now U.S. Pat. No. Des. 358,653; Ser. No. 29/024,683 now patent D360693; and, Ser. No. 29/024,684 now U.S. Pat. No. Des. 360,694 all filed Jun. 20, 1994. The entire previous applications are incorporated herein by reference as if set forth in full below.

BACKGROUND OF THE INVENTION

1. Field of the Invention

The present invention pertains to a device for use with babies or infants and, more particularly, to a padded pacifier holder designed to keep the pacifier in place whether the baby is sleeping or awake.

2. General Background

As is well known, babies or infants are generally comforted when they are allowed to suck on a pacifier. However, as is also well known, when the pacifier falls out of the babies' mouth, the baby is no longer comforted and generally cries until such time that the pacifier is replaced.

As the child grows, he learns how to replace the pacifier himself. In fact, many devices exist to aid the child in locating a "lost" pacifier, the most common device being a small string or ribbon having one end secured to the pacifier and the other end to the child, such as through a clip or the like. To help the child locate a lost pacifier in a darkened room, it is becoming increasingly common for the pacifier to "glow in the dark" so that it can thus be located by sight as well as by touch.

Pacifier holders taught by the prior art include: U.S. Pat. No. 3,556,104 issued to Janklow; U.S. Pat. No. 4,188,747 and U.S. Pat. No. 4,277,910 both issued to Kramer; U.S. Pat. No. 5,147,384 issued to LaRocca; U.S. Pat. No. 3,283,758 issued to Killebrew; U.S. Pat. No. 2,409,820 issued to Zimmern; U.S. Pat. No. 5,197,974 issued to Scarpelli, et al.; and, British Specification No. 766,082.

However, these devices are of no use to a new-born infant who cannot fend for himself. Nor can the new-born maneuver his limbs so as to grasp and replace a pacifier that has fallen out of his mouth. Furthermore, even when the new-born infant has the pacifier in his mouth, it frequently falls out or is unintentionally pushed out by the baby. In these cases, it is desirable for the pacifier to always be within reach of the baby so that it will always be available when needed.

It is thus an object of the present invention to provide a means of supporting a pacifier in relation to the infant such that the infant can find the pacifier when it is desired even though the baby may have pushed the pacifier out of his mouth.

Another object of this invention is to support the pacifier so that it is not likely to become lost or fall out during use.

Still another object of this invention is to provide access to the pacifier whether the baby is sleeping or awake.

Yet another object of this invention is to provide a comforting pad or cushion for the baby so that he will not only be comforted by having access to the pacifier, but also by feeling or being in contact with the pad or cushion.

Still another object of this invention is to conform the comforting pad or cushion so that it can lay alongside the baby, or even upon the baby's chest, while still enabling the baby to find comfort in the pacifier.

Yet another object of this invention is to provide the baby with a stimulating device while being so comforted so as to encourage the use of the baby's limbs, thereby increasing the baby's motor skills. These and other objects and advantages of this invention will become obvious upon further investigation.

SUMMARY OF THE PRESENT INVENTION

The preferred embodiment of the apparatus of the present invention solves the aforementioned problems in a straightforward and simple manner. What is provided is a pacifier holder that consists of an elongated, soft, flexible member having a first end region and an opposite second end region. The first end region is offset from the second by curvature of the first end region of the elongated member from the remainder of the elongated member. The first end region is also generally enlarged with respect to the remainder of the elongated member. A pacifier holding means is secured to this first end region and functions to secure a pacifier on a surface of the first end region. Surrounding or encasing the elongated member is a fabric shell that can be made of a single uniform material or a variety of different materials. Loops, a bow and noise maker can be added to occupy the infant.

BRIEF DESCRIPTION OF THE DRAWING

For a further understanding of the nature and objects of the present invention, reference should be had to the following description taken in conjunction with the accompanying drawing in which like parts are given like reference numerals and, wherein.

DETAILED DESCRIPTION OF THE PREFERRED EMBODIMENT

Figure 1:
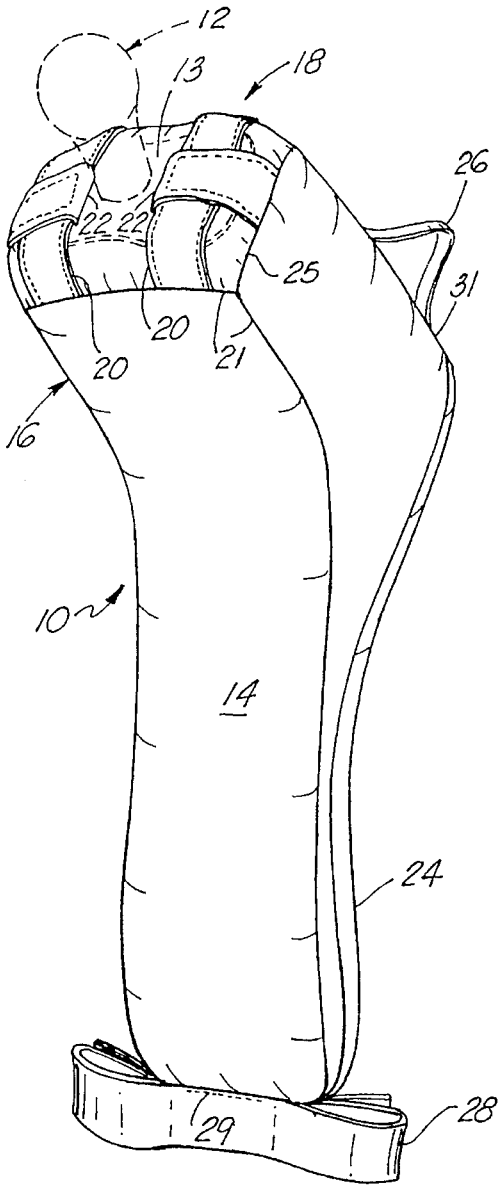
FIG. 1 is a right side and bottom perspective view of the preferred embodiment of the present invention (with the pacifier mounted to its holding means illustrated in phantom)

Referring to the drawing, there is shown pacifier holder 10. FIG. 1 illustrates how pacifier 12 (in phantom) can be held in place within pacifier holder 10. Holder 10 is generally constructed of a soft lightweight cushion or foam material enclosed within an elongated, somewhat tubular cloth shell 14 so that it will be comforting to the touch of an infant. The material on all of the surfaces of shell 14 can all be the same or, if desired, the different surfaces of shell 14 can all be made of different material. The advantage of constructing the different surfaces of shell 14 of different material is to provide the baby with a variety of differently textured material for the baby to touch and explore while also sucking on pacifier 12.

Figure 3:
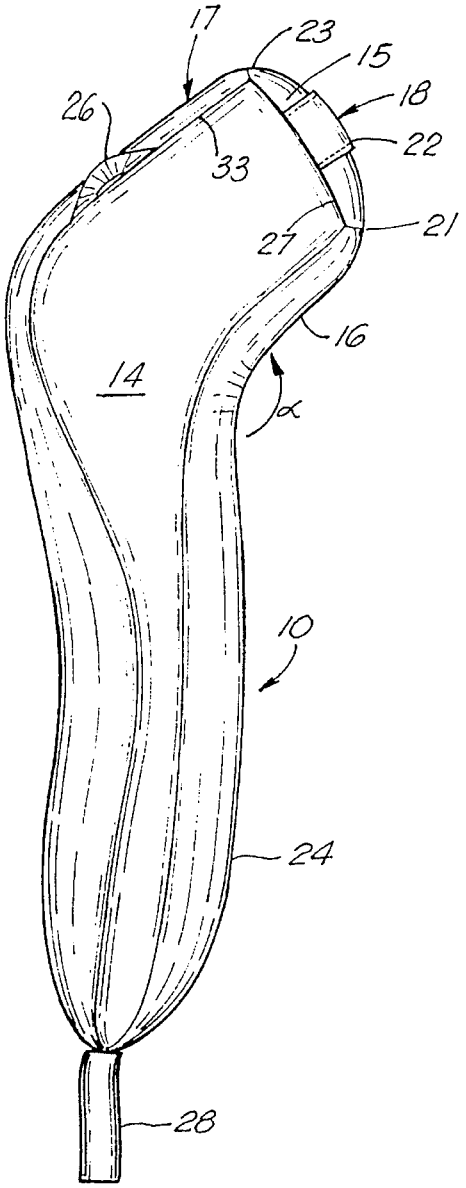
FIG. 3 is a left side view of the embodiment of FIG. 1.

Holder 10 can either be of uniform or non-uniform thickness along its length, but working end or upper region 16 is generally non-planar, offset, or curved with respect to the rest of holder 10. This working end region 16 (the end which supports pacifier 12 therein) is slightly offset from the remainder of elongated shell 14, as best seen in FIGS. 1 and 3, to hold pacifier 12 in a position accessible to the infant at all times. The actual angle of curvature G of working end region 16 to grasping or lower region 24 can vary, but generally shell 14 is configured such that when holder 10 is resting upon the infant's chest, working end or upper region 16 holds pacifier 12 at the angle α needed for the baby to suck or engage pacifier 12.

Pacifier 12 is preferably held in place on surface 15 of upper region 16 of holder 10 by securing means 18 comprising crossing straps 20, 22 sewn or otherwise attached to the upper surface 15 of upper region 16 of shell 14. When it is desired to either insert or remove pacifier 12 from securing means 18 of holder 10, straps 20 are generally moved aside (or laterally (outwardly) in the direction of ARROWS A and B of FIGS. 2 and 5) so as to provide such access to/for pacifier 12.

Figure 2:
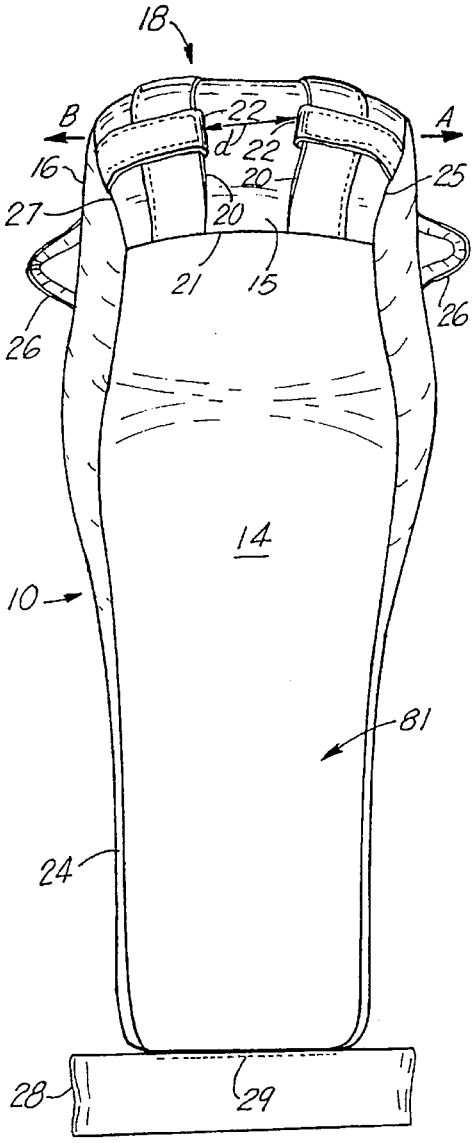
FIG. 2 is a front elevational view of the embodiment of FIG. 1 (illustrated without the pacifier in place)
Figure 5:
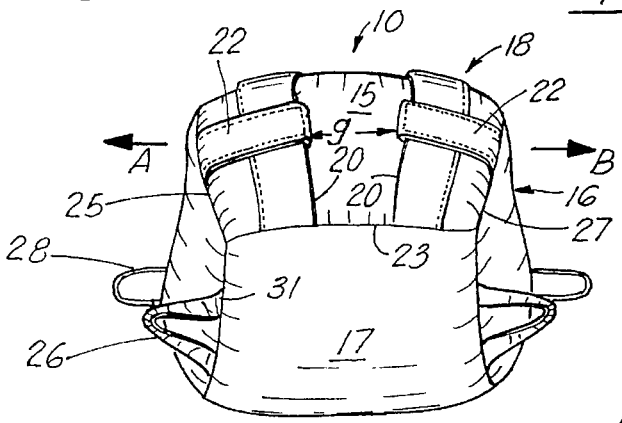
FIG. 5 is a top plan view of the embodiment of FIG. 1.

In this preferred embodiment and as best seen in FIGS. 1, 2 and 5, securing means 18 consist of two separate pairs of straps 20 and 22, each pair being positioned orthogonal to the other. The first pair of individual straps, pair 20, are positioned spaced apart (distance "g" of FIG. 5) and parallel to each other with each such strap 20 having its ends sewn or otherwise secured to marginal edges 21, 23 of surface 15 of shell 14. The second pair of individual straps, pair 22, are positioned co-linear with each other in such a manner that each such strap has only one of its ends sewn or otherwise secured to marginal edges 25, 27, respectively, of shell 14. The other end of each of straps 22 is respectively looped around an intermediate region of each of straps 20 forming gap or distance "g" best seen in FIG. 5. This looped end of each pair 22 can either be stitched or otherwise affixed to its respective intermediate region of straps 20 or each looped end can be slidable with respect to its respective intermediate region of strap 20. In this fashion, both pairs 20 and 22 of securing means 18 can be maneuvered out of the way (movement in the direction of ARROWS A and B), thereby permitting pacifier 12 to be inserted or removed from securing means 18 holder 10 as desired. This method of securing pacifier 12 to holder 10 also permits the baby to slightly move or jiggle pacifier 12 as needed therein so as to more fully and comfortably engage pacifier 12.

Located opposite working end region 16 is holding or grasping or lower region 24. This lower region 24 is generally of a smaller size than upper end region 16 and it is also slightly less bulky as well for easier grasping by the baby. Thus holder 10 is tapered from upper region 16 to lower region 24. In this fashion, if need be, the baby can push or shove holder 10 around as needed for either his own pleasure or to move pacifier 12 to a more comfortable position. This holding region 24 will generally be the portion of holder 10 that can be laid to rest upon the infant's chest, thus it is imperative that holder 10, and especially region 24, be both soft and light in weight.

It is also important that holder 10 be soft and flexible so that in the event the infant rolls over on top of holder 10, holder 10 will protect the baby from the hard, generally plastic base 13 of pacifier 12. Also, by being soft, holder 10 can also act as a pillow or a cushion for the infant. The size of holder 10 also aids in locating "lost" pacifiers, since pacifier 12 without holder 10 is more likely to become lost than a pacifier 12 secured to holder 10.

The preferred embodiment of holder 10 (and the embodiments of Ser. No. 29/024,684 and Ser. No. 29/024,663) would include a pair of finger loops 26 that can be used by the baby for either grasping, exercise purposes or just for fun and pleasure. These finger loops 26 would be secured to shell 14 in the normal fashion (stitching, etc.) on opposite sides of the marginal side edges 31, 33 of back surface 17 of working end region 16. Such loops 26 would include enough slack therein so that the baby could grasp and play with them when desired but not so much slack that the baby could tightly twist them around his fingers, thereby possibly injuring the baby. Additionally, these loops 26 would preferably be located in such a position (at marginal side edges 31, 33) that the baby could grasp them while also sucking on pacifier 12. Loops 26 can be made of the same material as shell 14 or they can be made of different material. It might also be desirable to construct finger loops 26 of a slightly elastic material in order to provide the baby with some light exercise opportunities. (These loops in an alternate embodiment can be replaced by a solid piece which would then be "ear-shaped" and stuffed with a cushioning material. These stuffed ear-shaped members would function as handles for the infant to grasp).

As stated earlier, shell 14 surrounds a soft foam or cushion material. However, holder 10 can also be constructed to include within this soft foam or cushion material a conventional rattle 40 (seen in phantom in FIG. 4) having a solid container 42 and pellets 44 therein or other noise maker for the baby's pleasure. Such noise maker can either be activated upon shaking (rattle 40) or upon squeezing as desired. The latter squeezing noise maker can be battery operated and it can also be of the kind that emits a short song or lullaby upon activation.

Figure 4:
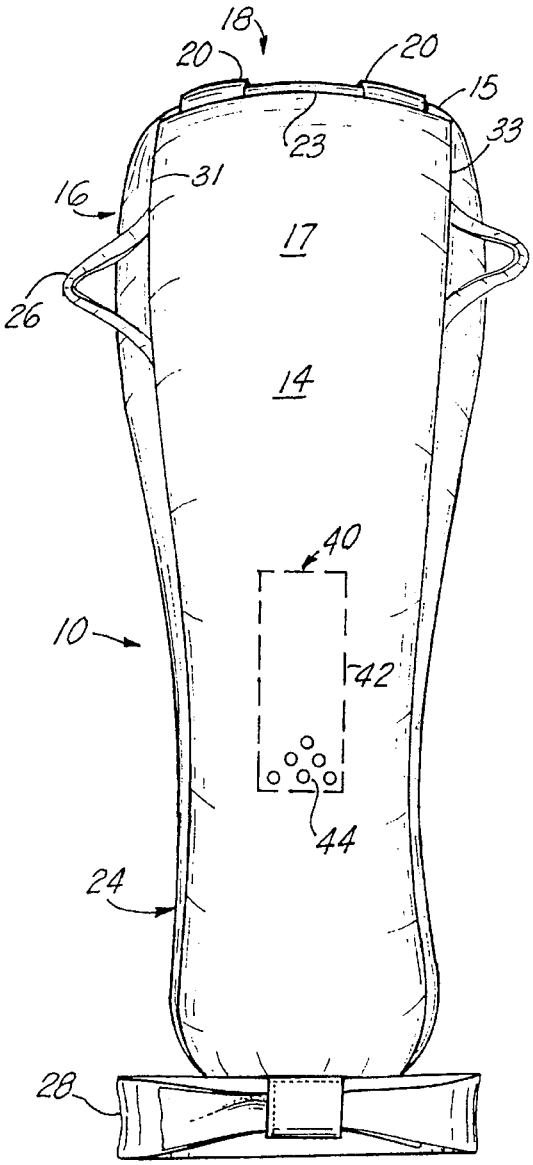
FIG. 4 is a rear elevational view of the embodiment of FIG. 1.
Figure 6:
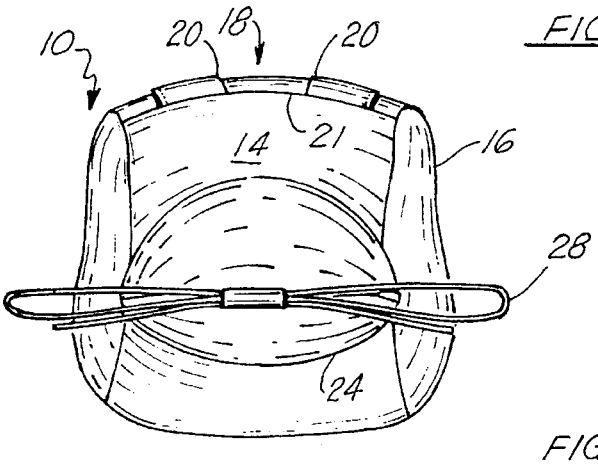
FIG. 6 is a bottom plan view of the embodiment of FIG. 1.

For decorative purposes, and also to provide the infant with another finger exercise or grasping exercise means, a bow or ribbon 28 can be secured to the bottom of holder 10, as best seen in FIGS. 1, 4 and 6. This bow 28, as best seen in FIGS. 1 and 2, is preferably stitched at seam 29 to the bottom seam of lower region 24 of shell 14 and it can be tied in the manner of a shoe lace. Such bow 28 can be the same color as shell 14 or it can be a different color, such as pink for female babies and blue for male babies. This bow 28, in conjunction with finger loops 26, provides a means for the baby to both grasp and play with holder 10 while at the same time sucking on pacifier 12.

In use, pacifier 12 would be inserted within securing means 18 of working end 16 of holder 10 underneath straps 20, 22, as best illustrated in FIG. 1. Once thus located, holder 10 with pacifier 12 therein, would be placed upon the baby's chest (the baby laying on his back) in such a manner that pacifier 12 would be inserted within the baby's mouth. With the curvature of working or upper end 16 relative to the remainder of holder 10, pacifier 12 can be so inserted while the front surface 81 of lower region 24 is positioned on top of the baby. This will help retain pacifier 12 within the baby's mouth whether the baby is asleep or awake. If awake, then the baby can also play with either finger loops 26 or bow 28 so as to keep himself occupied. As stated earlier, since holder 10 is to be positioned on top of the baby, it is imperative that holder 10 be both soft and lightweight so that no injury will come to the baby. In the event holder 10 falls out of place, then the soft cushion material comprising holder 10 will pad the baby or, alternately, holder 10 can be used as a means of wedging or supporting the baby in a certain position.

Because many varying and differing embodiments may be made within the scope of the inventive concept herein taught and because many modifications may be made in the embodiment herein detailed in accordance with the descriptive requirement of the law, it is to be understood that the details herein are to be interpreted as illustrative and not in a limiting sense.

What is claimed as invention is:

1. A pacifier holder comprising:

(a) an elongated member of a soft, cushioning material having a first end region and an opposing second end region, said first end region being offset from said elongated member by curvature from said elongated member;

(b) means secured to said first end region for holding a pacifier thereon, said means comprising flexible strap members connected to opposing marginal side edges of a first surface of said first end region;

(c) a plurality of loops secured to a second surface of said first end region; and, (d) a fabric shell encasing said elongated member.

2. The pacifier holder as set forth in claim 1, wherein said first end region is enlarged with respect to the remainder of said member.

3. The pacifier holder as set forth in claim 1, wherein said strap members further comprise first and second pairs of straps, said first and second pairs of straps each having straps being oriented generally orthoganal in relationship to each other.

4. The pacifier holder as set forth in claim 1, wherein said second surface has opposing marginal side edges and said loops are connected to said marginal side edges.

5. The pacifier holder as set forth in claim 4, further comprising a bow secured to said second end region.

6. The pacifier holder as set forth in claim 1, further comprising means for generating an audible sound, said means comprising a container having pellets therein secured within said elongated member.

7. The pacifier holder as set forth in claim 6, wherein said means for generating an audible sound is activated by shaking said elongated member.

8. A pacifier holder comprising:

(a) an elongated member of a soft, cushioning material having a first end region and an opposing second end region, said first end region being offset from said elongated member by curvature from said elongated member;

(b) means secured to said first end region for holding a pacifier thereon, said means comprising flexible strap members connected to opposing marginal side edges of a first surface of said first end region;

(c) a plurality of loops secured to a second surface of said first end region; and, (d) a fabric shell encasing said elongated member.

9. The pacifier holder as set forth in claim 8, wherein said first end region is enlarged with respect to the remainder of said member.

10. The pacifier holder as set forth in claim 8, wherein said strap members further comprise first and second pairs of straps, said first and second pairs of straps each having straps being oriented generally orthoganal in relationship to each other to provide a gap between said pairs.

11. The pacifier holder as set forth in claim 8, wherein said second surface has opposing marginal side edges and said loops are connected to said marginal side edges.

12. The pacifier holder as set forth in claim 11, further comprising a bow secured to said second end region.

13. The pacifier holder as set forth in claim 8, further comprising means for generating an audible sound, said means comprising a container having pellets therein secured within said elongated member.

14. The pacifier holder as set forth in claim 13, wherein said means for generating an audible sound is activated by shaking said elongated member.

15. The pacifier holder as set forth in claim 8, wherein said elongated member is generally tubular.

* * * * *